US007285102B1

(12) United States Patent
Chang

(10) Patent No.: US 7,285,102 B1
(45) Date of Patent: Oct. 23, 2007

(54) DUAL USE MASSAGE CHAIR

(76) Inventor: Horng Jiun Chang, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 11/589,251

(22) Filed: Oct. 30, 2006

(51) Int. Cl.
*A61H 15/00* (2006.01)

(52) U.S. Cl. ..... 601/98; 601/102; 601/148

(58) Field of Classification Search ..... 601/49, 601/52, 84, 86, 89, 90, 93, 94, 97, 98, 99, 601/101–103
See application file for complete search history.

(56) References Cited

U.S. PATENT DOCUMENTS 5,741,218 A * 4/1998 Fujii ..... 601/90
6,805,680 B2 * 10/2004 Klingler ..... 601/115
7,029,453 B2 * 4/2006 Chen ..... 601/99
7,066,898 B2 * 6/2006 Mori et al. ..... 601/99

* cited by examiner

*Primary Examiner*—Quang D. Thanh
(74) *Attorney, Agent, or Firm*—C. G. Mersereau; Nikolai & Mersereau, P.A.

(57) ABSTRACT

A dual use massage chair has inflatable and deflatable air bags and bladders in a chair back to provide a massage function and serve as a comfortable chair. The main structure thereof includes the air bags disposed at two sides of a seat and in a front cover, and the bladders and recovering springs disposed between a massage mechanism and a back frame. Inflating the air bags and the bladders respectively or simultaneously can form a separating space for separating the massage mechanism from a back of a human body and thus to form a comfortable sofa chair. Also, the bladders and the air bags may be deflated to recover the use of the normal massage chair. Thus, the utilities of the comfortable chair and the typical massage chair can be achieved.

3 Claims, 6 Drawing Sheets

DUAL USE MASSAGE CHAIR

BACKGROUND OF THE INVENTION (1) Field of the Invention

The present invention relates to a dual use massage chair, which mainly includes inflatable and deflatable air bags and bladders between a seat, a back frame and a massage mechanism. The air bags and the bladders may be inflated and deflated respectively or simultaneously in conjunction with recovering springs for pulling the massage mechanism so that the massage chair can serve as the comfortable sofa and provide the typical massage function.

(2) Description of the Prior Art

Modern human beings have aches on necks, shoulders and backs due to working conditions, abnormal daily life and the lack of the proper exercise. In addition, the diet is getting more and more tasteful, and too much fat has been eaten. Thus, the body function is getting worse, and some diseases of civilization bother many people. Under the concept of health maintenance, various massage centers emphasizing health have been gradually established. Pressing acupuncture points can circulate the blood and relax the muscles to make the user feel comfortable while eliminating the fatigue of work and improving various aches caused by poor postures. This is a great gospel to the busy modern human beings. In addition, some manufacturers have provided various massage apparatuses according to personal and family demands.

Among various massage apparatuses and massage methods available in the market, massage bars, massagers, massage chair mats and multi-function massage chairs are frequently seen. In addition, the user may choose a professional massage center to do the professional massage. These different methods can indeed achieve different massage effects. The massage bar or the massager is usually composed of simple members to locally massage the body by way of vibration or knocking. However, the effect thereof is not significant under the limitation of the structural function.

The massage chair mat is mainly designed according to the requirements of the drivers. The massage chair mat can be easily placed on the original chair for massage, but still has the limited function for temporarily easing the fatigue. If the driver wants to be massaged by the professional in the massage center, he or she has to pay a lot of money and time.

It is preferred to massage the whole body to achieve the predetermined effect. Thus, some manufacturers continuously develop multi-function massage chairs to meet the requirements of consumers. This kind of massage chair can massage the whole body in multiple modes, and can press and knock the neck, the shoulders, the back, the buttock, and the legs to eliminate the fatigue and improve the ached portions so as to loose the body and the spirit. In addition, the massage chair can ease the fatigue and aches of the old man. However, most people may enjoy the excellent massage in the comfortable massage chair and unwittingly fall asleep or close the eyes to take a rest. After the massage procedure ends, the massage rollers of the mechanism are stopped and still in contact with the body. Thus, the user may feel uncomfortable and leave the massage chair. So, the massage chair cannot provide the same comfortable function as the typical sofa chair, and still has to be improved.

SUMMARY OF THE INVENTION

In view of the drawback of the typical massage chair, the inventor has done a lot of research to invent a dual use massage chair according to the experience and the technology. The main object is to provide the massage function of the massage chair and the comfortable function in the comfortable sofa formed by the inflatable air bags and bladders. Thus, the comfortable property and the utility can be enhanced.

Another object of the invention is to inflate or deflate the bladders and the air bags in the massage chair respectively or simultaneously in conjunction with the structural function design to achieve the better massage and comfortable seating effects.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

The structure, technological means and effect of the present invention will be described in conjunction with several embodiments with reference to the accompanying drawings.

Figure 1:
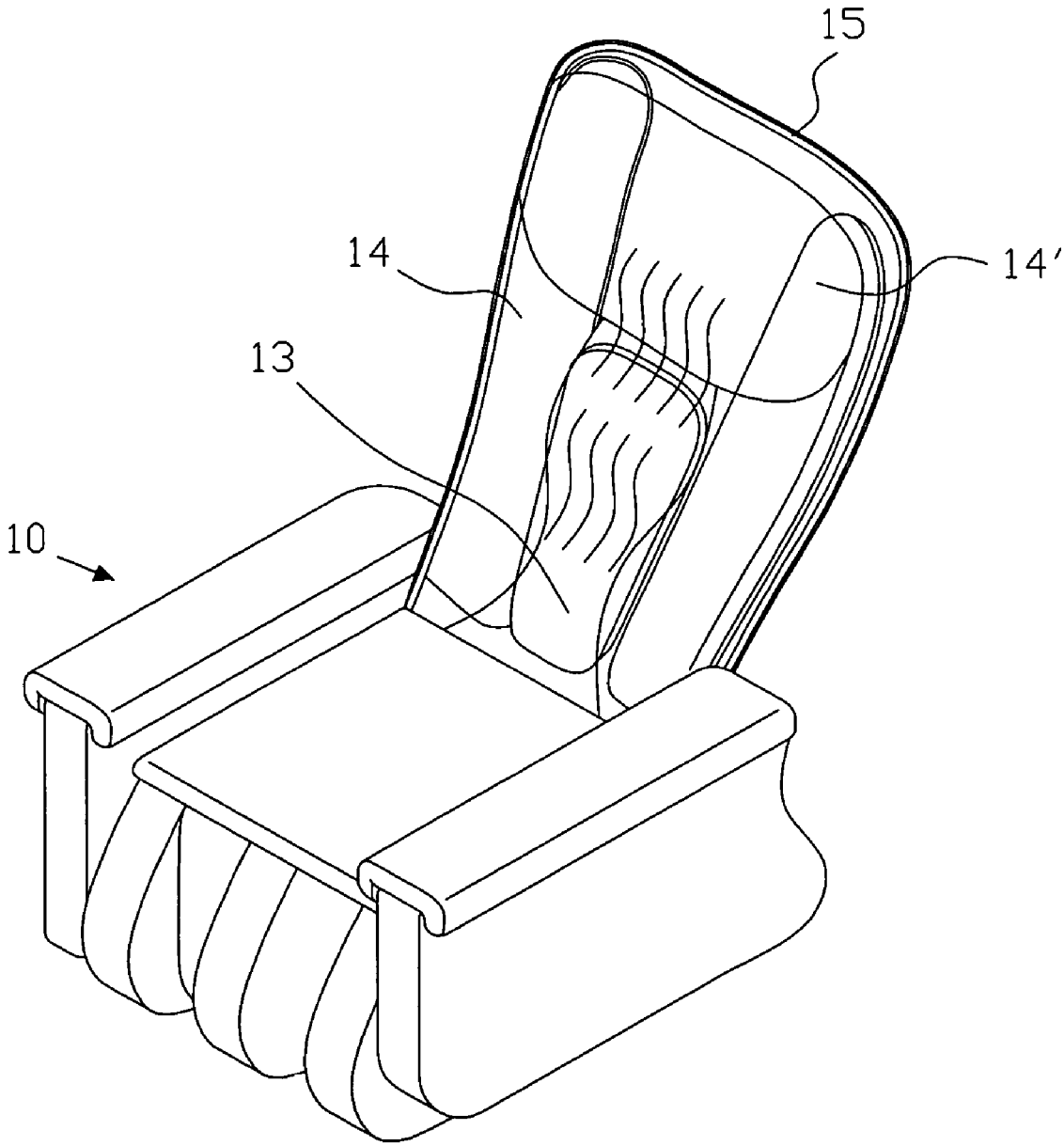
FIG. 1 is a pictorial view showing a deflating bladder of a dual use massage chair according to the present invention.
Figure 2:
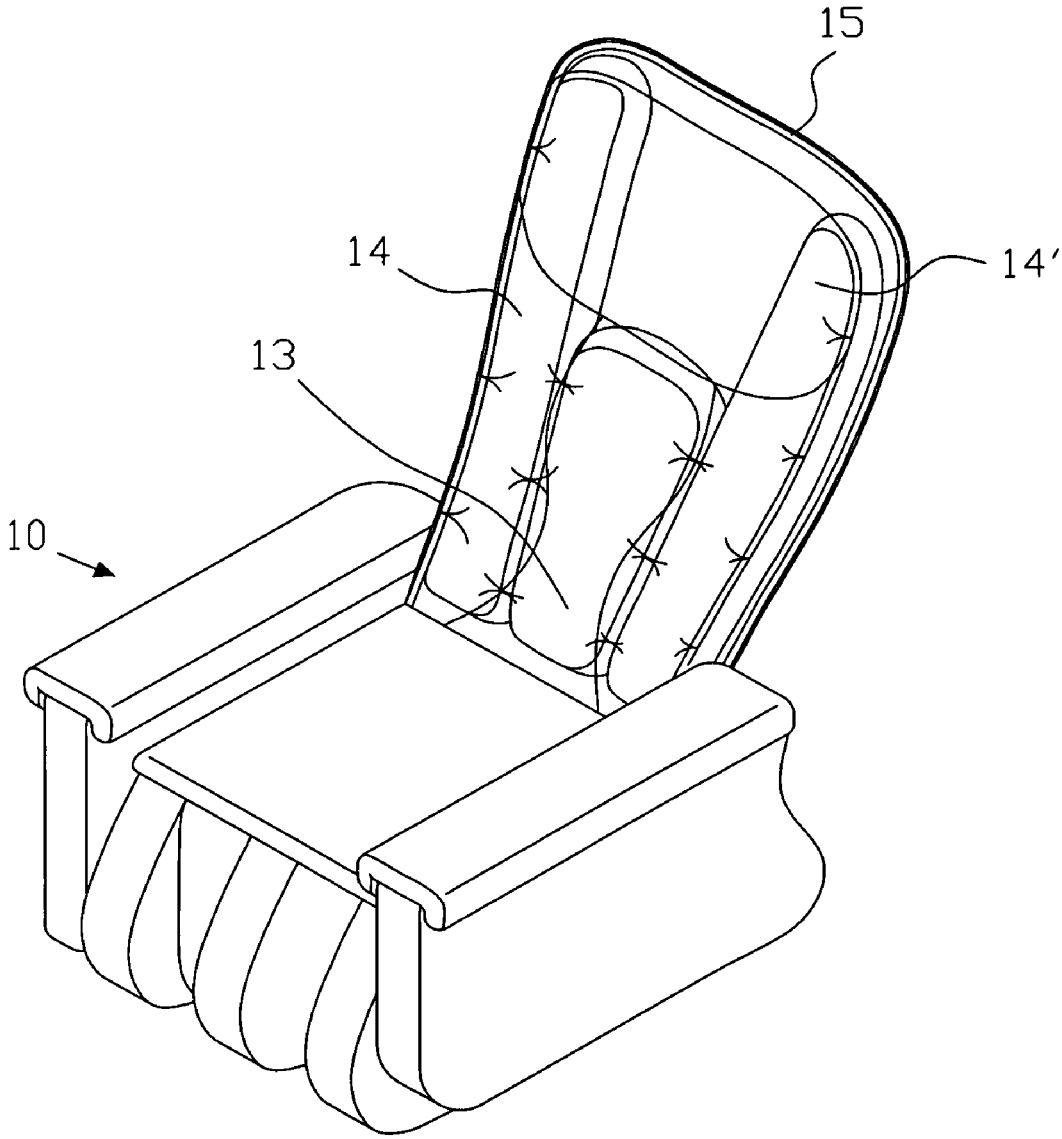
FIG. 2 is a pictorial view showing the inflating bladder of the dual use massage chair according to the present invention.
Figure 3:
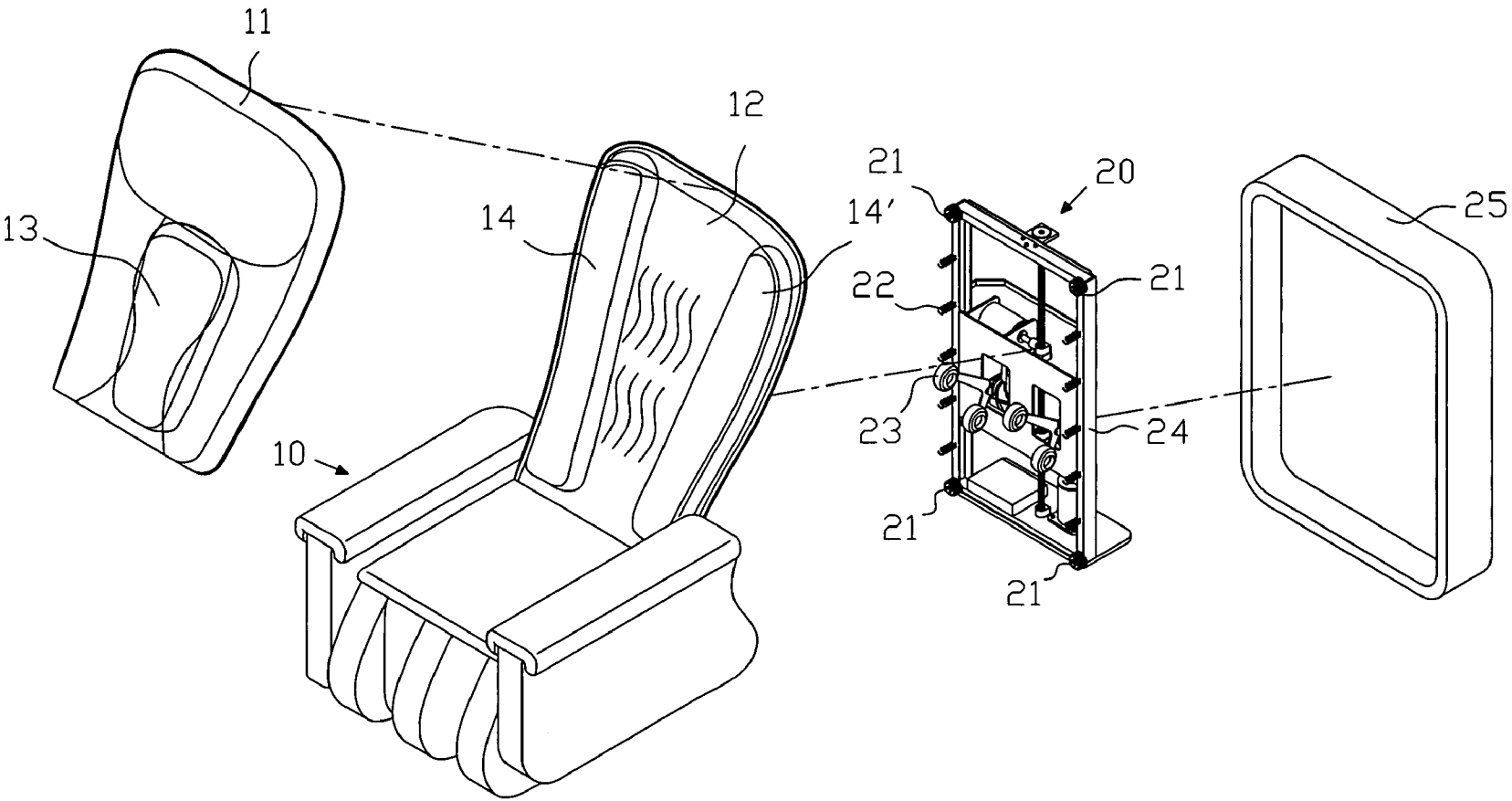
FIG. 3 is a schematically exploded illustration showing a structure of the dual use massage chair according to the present invention.

First, as shown in FIGS. 1 to 3, a chair back 15 of the present invention has the composite design, which is mainly a structure composed of a backrest 12 and a front cover 11. Air bags 13, 14 and 14' are respectively disposed in the backrest 12 and the front cover 11. An inflating device inflates the air bags 13, 14 and 14' disposed in the backrest 12 and the front cover 11 to form a massage chair 10 having a thick structure and an excellent supporting property. When the user is seated on the chair 10, the air bags 14 and 14' in the backrest 12 contact two sides of the vertebra of the user's back. Meanwhile, the air bag 13 disposed in the front cover 11 can contact the waist of the user to provide a good supporting property. Because the back of the human body is pushed forward gently, the back is moved away from massage wheels 23 in the back of the human body. Thus, the comfortable seating property is provided when no massage operation occurs.

Figure 4:
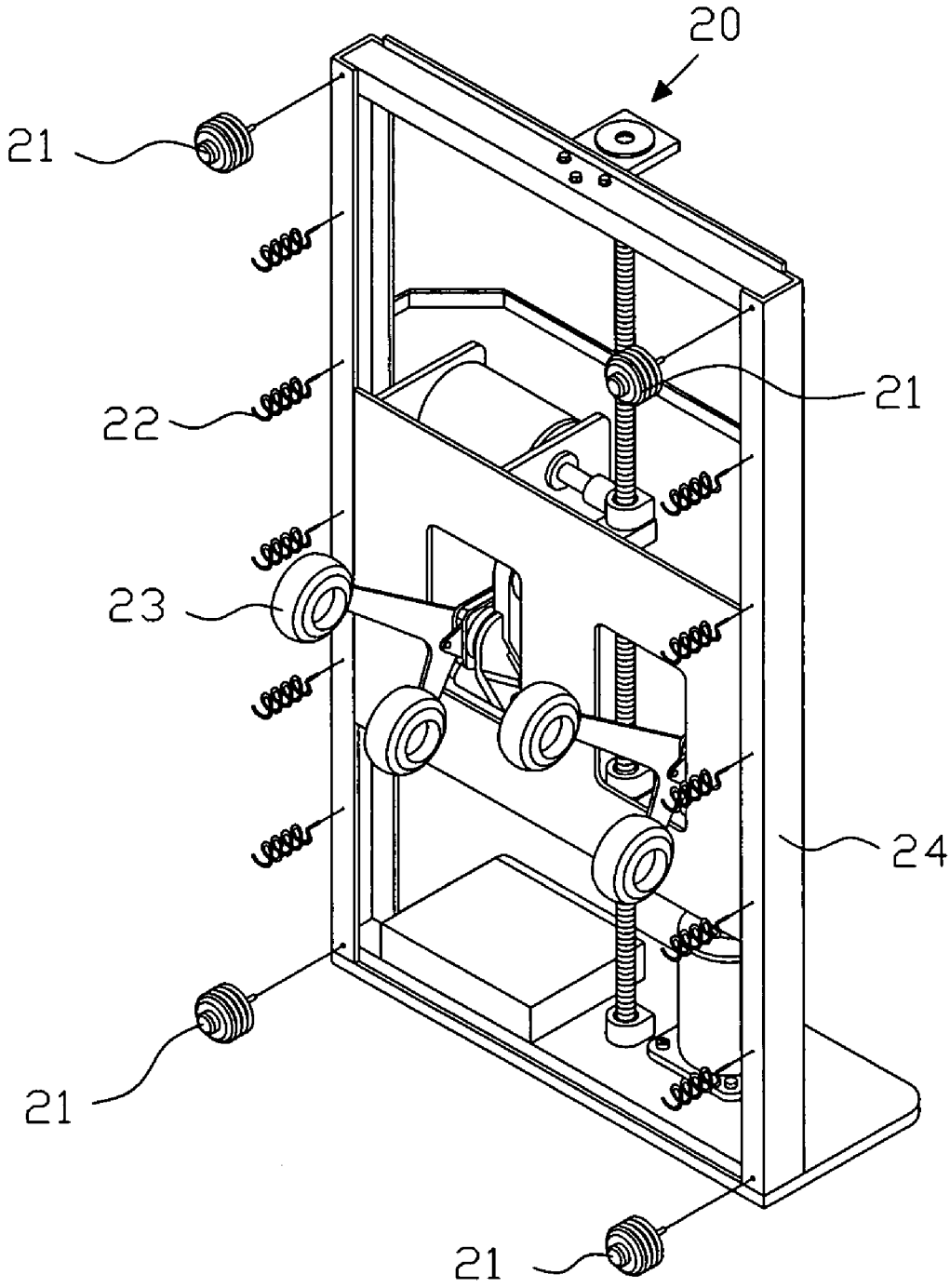
FIG. 4 is a schematic illustration showing a massage mechanism according to the present invention.

Next, as shown in FIG. 4, a massage mechanism 20 is composed of the massage wheels 23 and a frame 24. The frame 24 is composed of bladders 21 and recovering springs 22. The user operates the control button to control the inflating device to inflate the bladders 21 in the frame 24 to push the massage mechanism 20 backward slowly. Thus, a separating space for separating the massage mechanism 20 from the back of the human body is formed. At this time, the massage wheels 23 on the frame 24 are moved away from the user's back so that the massage chair 10 provides the property of the comfortable sofa chair to create a different kind of comfortable seating space of the massage chair 10. When the massage function is again enabled, the bladders 21 are deflated and the massage mechanism 20 is moved forward through the pulling forces of the recovering springs 22 so that the massage wheels 23 on the frame 24 again approximate the user's back to perform various massage functions.

Figure 5:
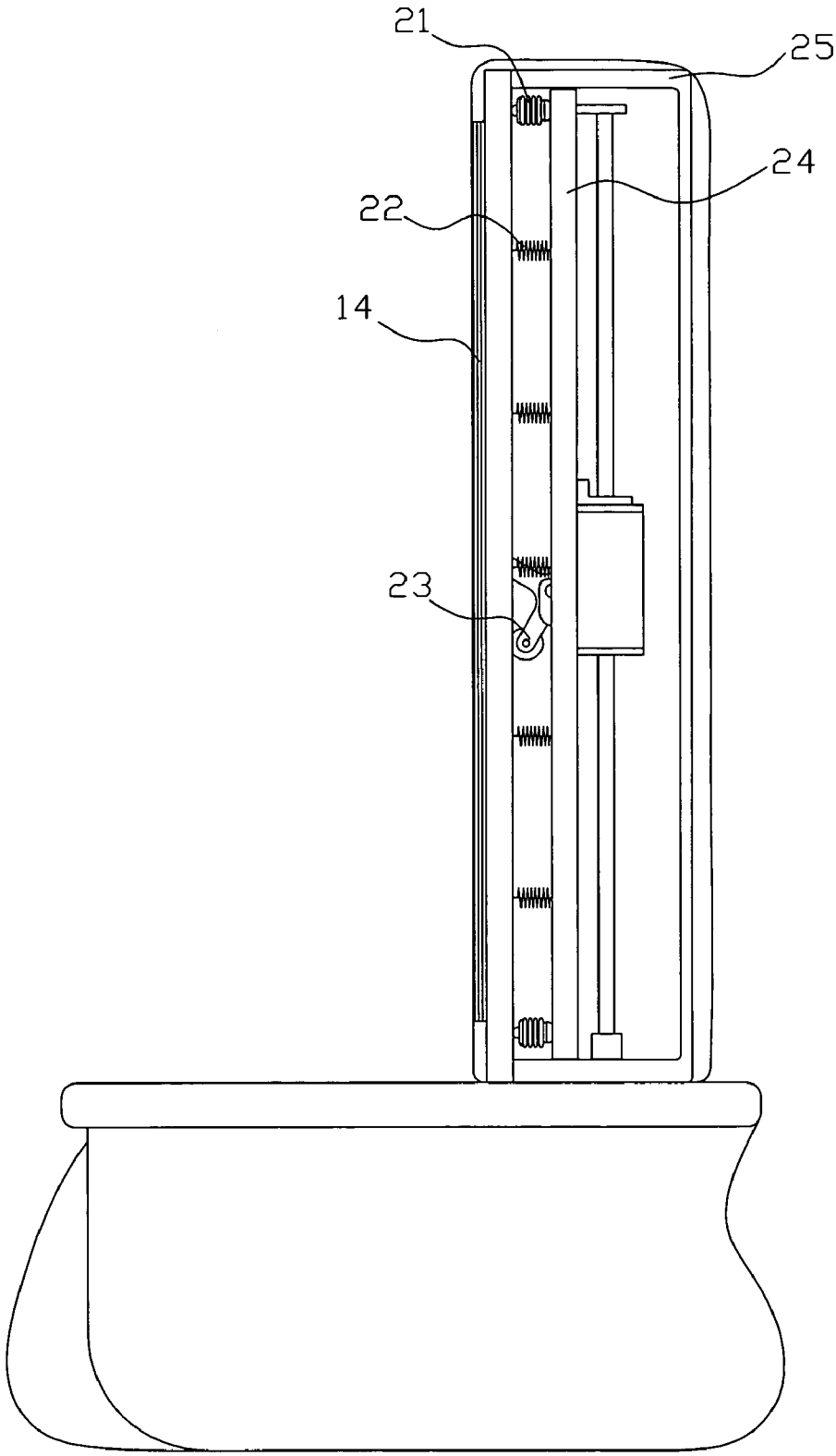
FIG. 5 is a schematic illustration showing the completed deflation according to the present invention.
Figure 6:
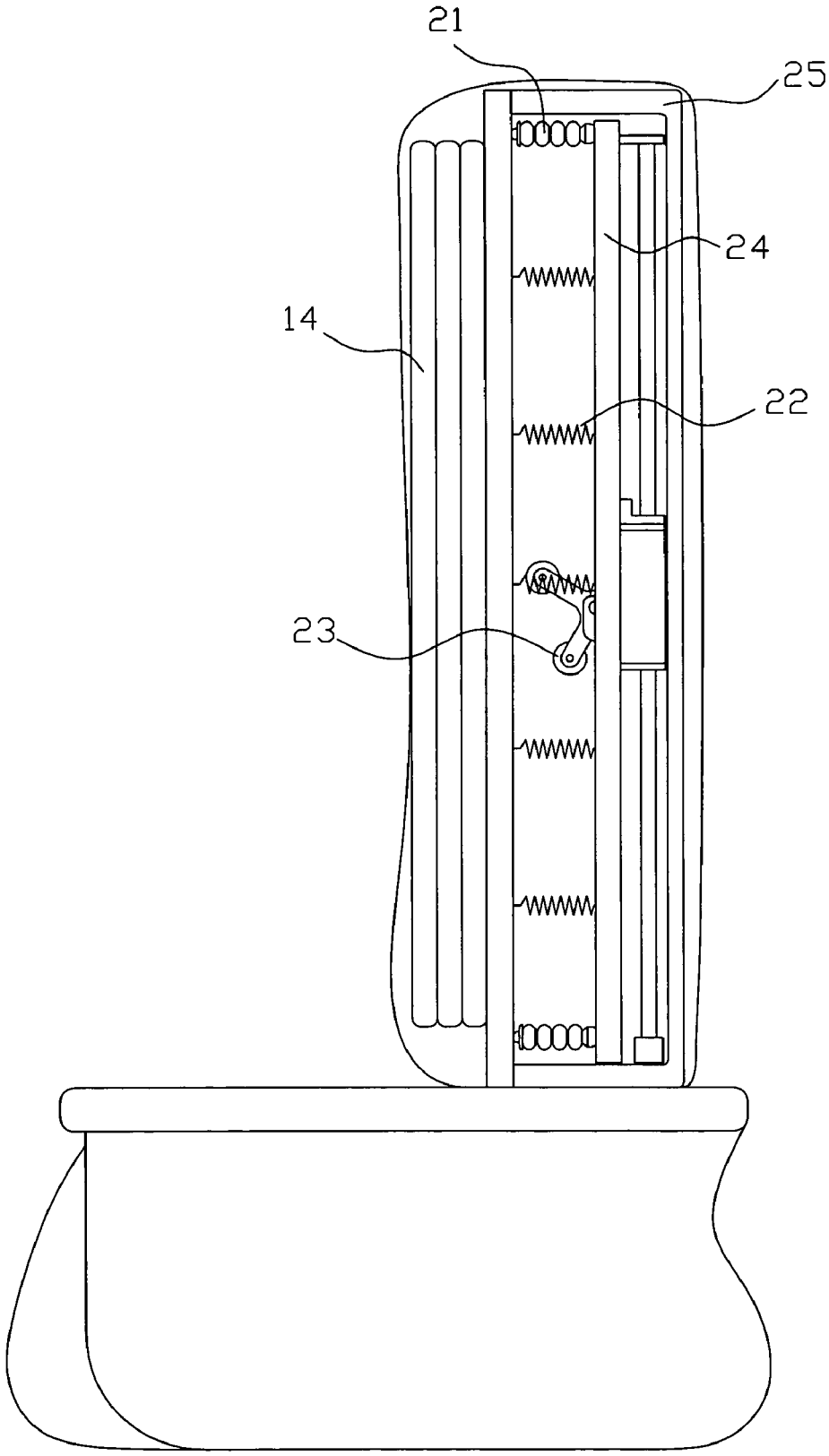
FIG. 6 is a schematic illustration showing the completed inflation according to the present invention.

Then, as shown in FIGS. 5 and 6, when the air bags 13, 14 and 14' disposed at the front side of the chair of the present invention and the bladders 21 disposed in the backside are inflated and deflated, the massage mechanism 20 can be moved back and forth in a space of a back cover 25. The inflating and deflating operations may be executed respectively or simultaneously to fit with various users with different sizes, to ensure the comfortable property like the sofa chair. Thus, it is possible to prevent the user's back from contacting the massage wheels 23 and thus prevent the user from feeling uncomfortable when the user is seated on the chair 10 in the massage-disabled state or when the user lies against the massage chair 10. In addition, the user may set, through the control button, the massage mechanism 20 to separate from the user's back immediately and automatically when the massage procedure ends even if the user comfortably falls asleep or closes his/her eyes to take a rest during the massage procedure. Thus, the comfortable human-oriented seating space can be provided. In addition, the air cushion chair back 15 can effectively ease the mugginess in the summer and thus enhance the comfortable property.

In summary, the dual use massage chair 10 of the present invention has the excellent utility.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A dual use massage chair, comprising:

air bags disposed at two sides of a backrest and disposed in a front cover; and bladders and recovering springs disposed between a massage mechanism and a chair back, the chair back being comprised of the backrest and the front cover;

wherein a space between the chair back and the massage mechanism is formed so that when the air bags and the bladders are inflated, the massage mechanism is pushed backward in the space thus permitting the massage chair to serve as a comfortable chair, and the recovering springs pull the massage mechanism forward to a normal massage state after the bladders and the air bags are deflated thereby permitting the massage chair to provide a massage function.

2. The massage chair according to claim 1, wherein the air bags and the bladders may be inflated or deflated respectively or simultaneously.

3. The massage chair according to claim 1, wherein the bladders and the air bags are inflated when a massage procedure ends.

* * * * *